US007779586B2

(12) United States Patent
Stewart et al.

(10) Patent No.: US 7,779,586 B2
(45) **Date of Patent: *Aug. 24, 2010**

(54) MULTISTORY APARTMENT MODULE WITH STAIRWAYS TO SINGLE CORRIDOR

(75) Inventors: Jerry W. Stewart, Dallas, TX (US); W. Bryan Thruston, Dallas, TX (US)

(73) Assignee: S&T Joint Venture, Dallas, TX (US)

( * ) Notice: Subject to any disclaimer, the term of this patent is extended or adjusted under 35 U.S.C. 154(b) by 911 days.

This patent is subject to a terminal disclaimer.

(21) Appl. No.: 10/841,704

(22) Filed: May 7, 2004

(65) Prior Publication Data

US 2004/0206018 A1 Oct. 21, 2004

Related U.S. Application Data

(63) Continuation-in-part of application No. 10/081,412, filed on Feb. 22, 2002, now Pat. No. 7,036,281.

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |

(52) U.S. Cl. ..... 52/236.3; 52/185; 52/79.2; 52/175; 52/234

(58) Field of Classification Search ..... 52/185, 52/236.1, 169.4, 79.1, 236.3, 169.3, 169.9, 52/175, 236.5, 79.2, 174, 234
See application file for complete search history.

(56) References Cited

U.S. PATENT DOCUMENTS

| | | | | |
|---|---|---|---|---|
| 2,698,973 A | | 1/1955 | Zeckendorf et al. | |
| 3,479,781 A | | 11/1969 | Johnson | |
| 3,603,047 A | | 9/1971 | Tournier | |
| 3,656,266 A | | 4/1972 | Tylius | |
| 3,750,354 A | | 8/1973 | Boros | |
| 3,755,974 A | | 9/1973 | Berman | |
| 3,923,096 A | * | 12/1975 | van der Lely | 165/48.1 |
| 4,003,182 A | | 1/1977 | Wokas | |
| 4,054,014 A | * | 10/1977 | van der Lely | 52/745.03 |
| 4,078,344 A | * | 3/1978 | van der Lely | 52/79.11 |
| 4,596,097 A | | 6/1986 | Stewart et al. | |
| 4,602,464 A | | 7/1986 | Medel | |

(Continued)

OTHER PUBLICATIONS

"Building With Outinord" (Outinord Universal, Inc. Website), 1999, 6 pages.

(Continued)

*Primary Examiner*—Richard E Chilcot, Jr.
*Assistant Examiner*—Chi Q Nguyen
(74) *Attorney, Agent, or Firm*—Gardere Wynne Sewell LLP; Kenneth R. Glaser

(57) ABSTRACT

A multistory, multiple dwelling unit building complex includes at least one three story module wherein first and third levels include one or more dwelling units serviced by an elevator. A corridor is provided on an intermediate level and stairways extend between the dwelling units on the first and third levels and the corridor. Exit stairways also extend between the corridor and the first and third levels and may be accessed directly from vestibules associated with the elevator or from other doorways between stairway landings and respective dwelling units.

22 Claims, 6 Drawing Sheets

U.S. PATENT DOCUMENTS

| | | | | |
|---|---|---|---|---|
| 4,794,747 | A * | 1/1989 | Yendo | 52/236.3 |
| 4,918,889 | A | 4/1990 | Lundstrom et al. | |
| 5,109,642 | A | 5/1992 | Ayala et al. | |
| 5,809,704 | A | 9/1998 | Stewart et al. | |
| 6,058,664 | A | 5/2000 | Brownlee, III | |
| 6,155,012 | A | 12/2000 | Halbitte | |
| 6,405,496 | B1 | 6/2002 | Stewart et al. | |
| 6,550,197 | B1 * | 4/2003 | Gray | 52/236.3 |
| 7,036,281 | B2 * | 5/2006 | Stewart et al. | 52/236.3 |

OTHER PUBLICATIONS

"Simply Remarkable High-Rise Living" (Excelsiorliving.com Website), 2000, 7 pages, Genesis Real Estate.

* cited by examiner

MULTISTORY APARTMENT MODULE WITH STAIRWAYS TO SINGLE CORRIDOR

CROSS-REFERENCE TO RELATED APPLICATION

This application is a continuation-in-part of U.S. patent application Ser. No. 10/081,412 filed Feb. 22, 2002, now U.S. Pat. No. 7,036,281.

BACKGROUND OF THE INVENTION

As discussed in the above-referenced co-pending patent application, a multistory apartment or other dwelling unit module which provides auxiliary or emergency exit corridors on selected floors is advantageous in regard to adding living space to selected dwelling units in the module and reducing the cost of construction of multistory multiple dwelling unit complexes. Such an arrangement also provides for access by service personnel to each dwelling unit while also providing an emergency or auxiliary pathway between each dwelling unit and an exit corridor without requiring that occupants of a dwelling unit travel more than one floor or level from the floor or level on which they are disposed.

However, in addition to the advantages provide by a multistory multiple dwelling unit complex as described above, it has been deemed desirable to provide additional access between dwelling units on an upper level and a lower level and an exit corridor on an intermediate level and which access does not require traveling through a dwelling unit.

For example, for dwelling units configured in accordance with the invention disclosed and claimed in application Ser. No. 10/081,412, primary access to each dwelling unit by the dwelling unit owner or occupant is via a semi-private or private elevator. In the event emergency personnel, such as firemen or emergency medical technicians, require access to a particular dwelling unit, it is desirable to provide an exit stairway adjacent an elevator so that, in the event of requiring immediate egress from a dwelling unit, an exit stairway is accessible directly adjacent an elevator to an exit corridor on a level or floor of the complex which is no more than one floor away from the floor or level from which egress is desired. A multistory multiple dwelling unit complex or module in accordance with the present invention provides a solution to this problem.

SUMMARY OF THE INVENTION

The present invention provides an improved, multistory, multiple dwelling unit complex including a three story or three level module arrangement which includes access to a service or exit corridor on a central or middle floor of the three story module.

In accordance with an important aspect of the present invention, a multistory, multiple dwelling unit building complex is provided with a three story module arrangement wherein one or more dwelling units on a first level have access to a service or auxiliary exit corridor on a second or intermediate level, one or more dwelling units on the second or intermediate level have access to the corridor and one or more dwelling units on a third level also have access to the corridor. Access to the corridor from the first and third levels is by way of a single flight of stairs leading directly to the corridor on the intermediate level.

In preferred embodiments of the invention, the three story module is served by private or semiprivate elevators leading directly to the respective dwelling units on each level. In accordance with the present invention, additional emergency exit stairs are provided in proximity to the elevators to provide access directly to the service corridor from areas directly adjacent the elevator openings at each level. In this way, more direct pathways between elevators and a service/exit corridor are provided in accordance with the invention.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENTS

Figure 1:
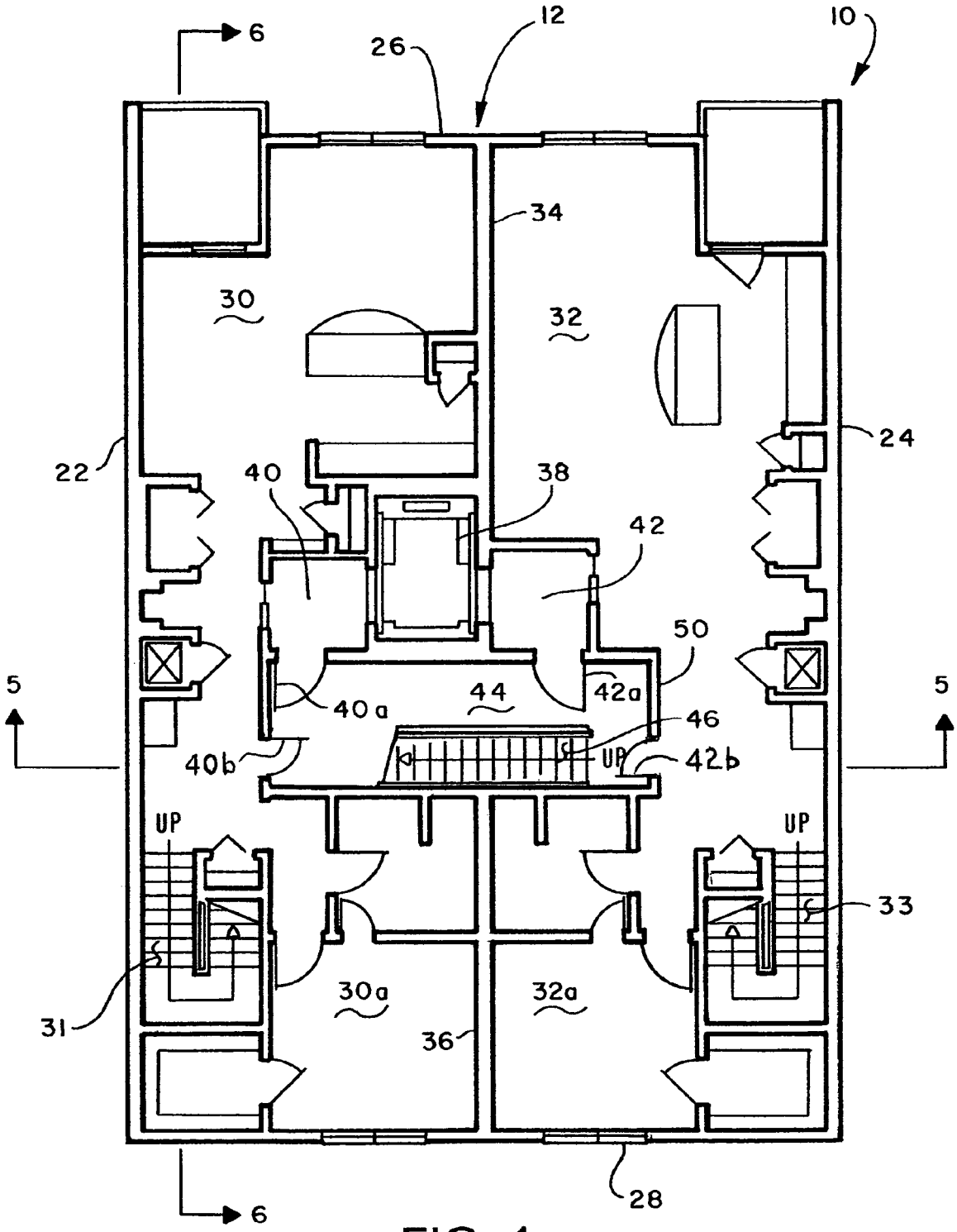
FIG. 1 is a plan view of a first floor or first level of a multistory, multiple dwelling unit complex in accordance with the invention.

In the description which follows, like features or elements are marked throughout the specification and drawing with the same reference numerals, respectively. The drawing figures may not be to scale in the interest of clarity and conciseness.

The drawing figures illustrate a typical three story module for a multistory, multiple dwelling unit building complex in accordance with the invention. Multiple three story modules may be "stacked" one on top of another, as well as disposed side by side, a predetermined number of times in a low-rise, mid-rise or high-rise building complex. One or more modules may, preferably, be built over a single or multistory motor vehicle garage or parking deck. In the embodiment described in detail herein, by way of example only, a three story module is shown mounted above a single parking level.

Figure 5:
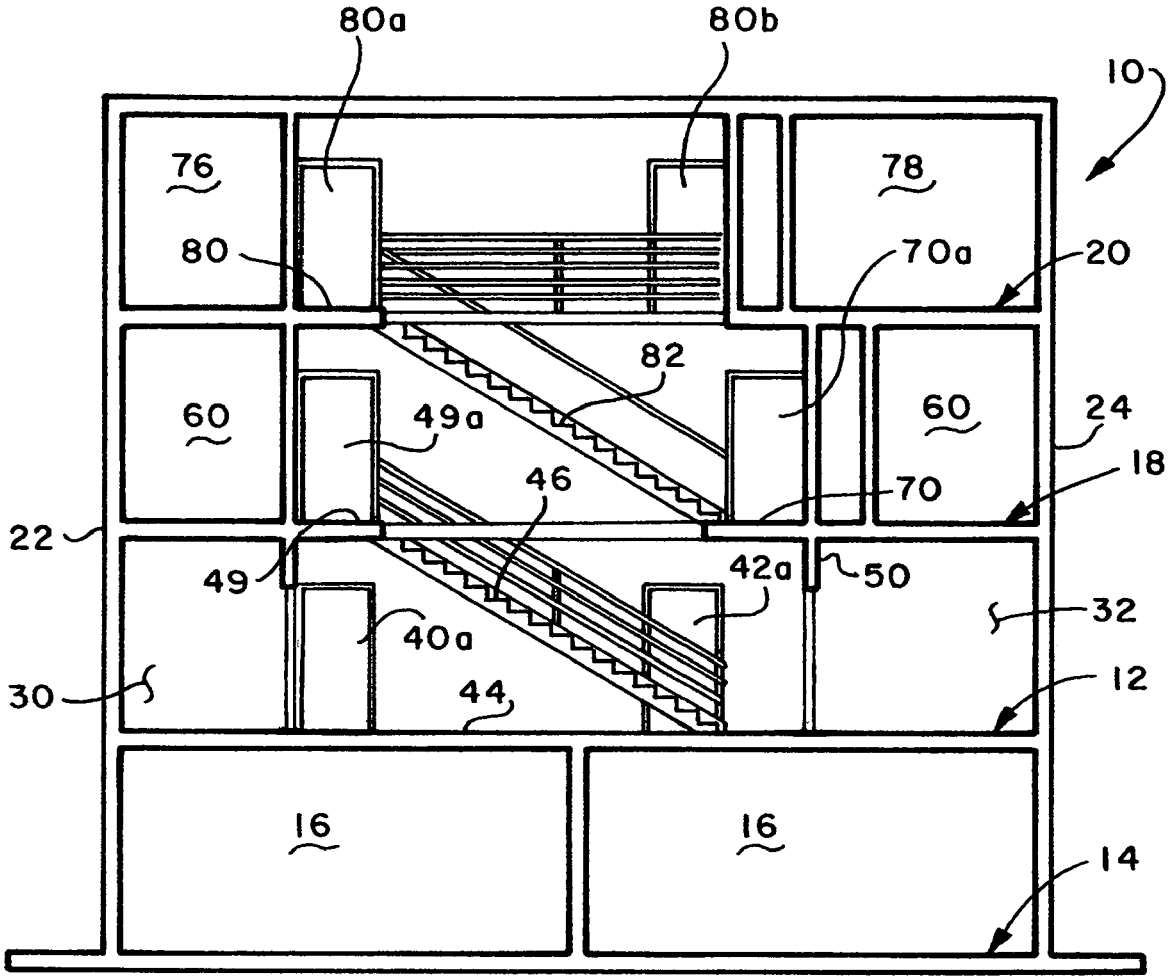
FIG. 5 is a section view taken generally along line 5-5 of FIGS. 1 through 4, respectively.
Figure 6:
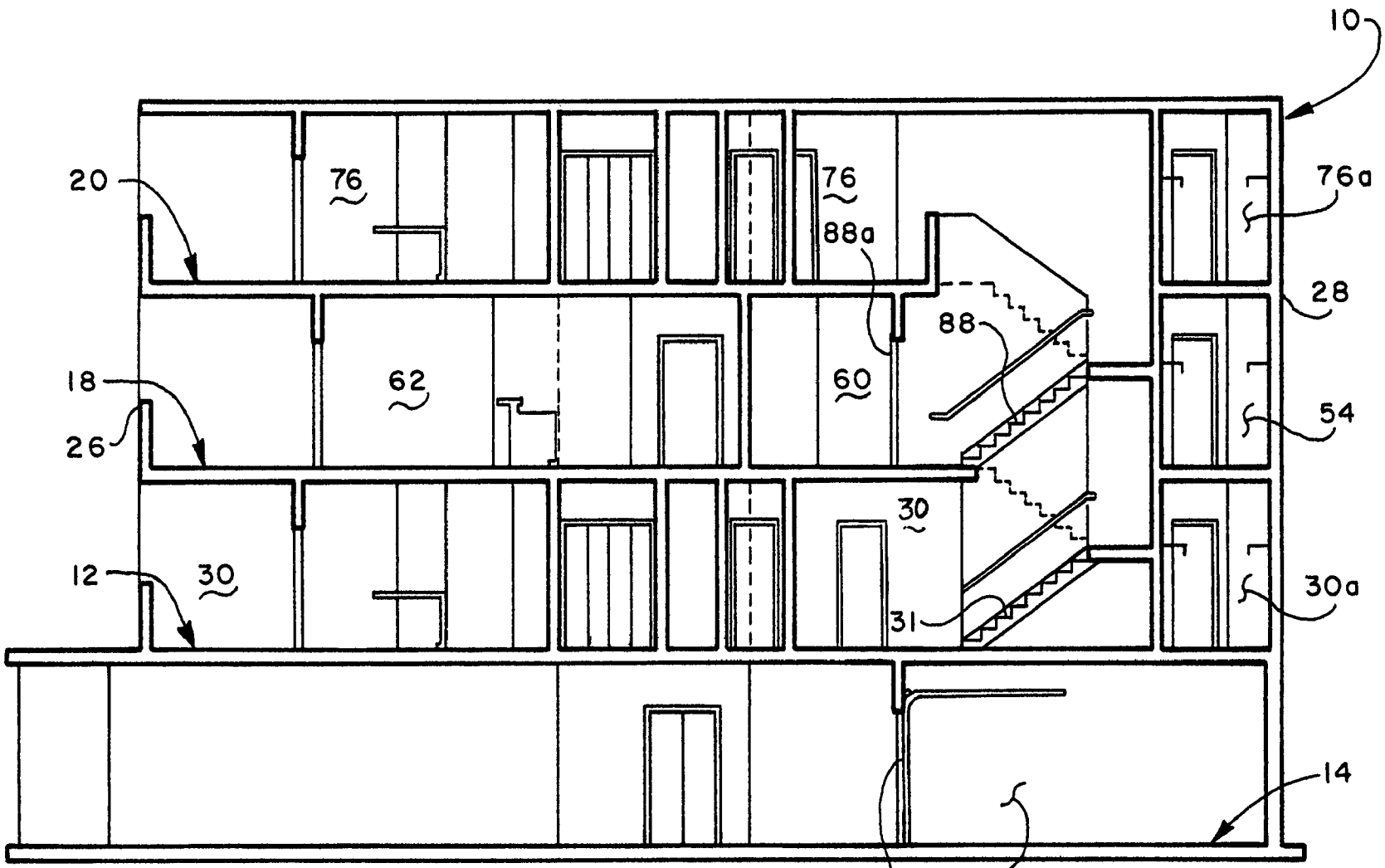
FIG. 6 is a section view taken generally along the line 6-6 of FIGS. 1 through 4, respectively.

Referring to FIGS. 1, 5 and 6 a multistory multiple dwelling unit building complex in accordance with the invention is illustrated and generally designated by the numeral 10. The first "floor" or first "level" of dwelling units for the complex or module 10 is indicated by numeral 12 and the module 10 is also disposed over a single parking level 14 having one or more parking spaces or garages 16, which may include doors 16*a*, one shown in FIG. 6, as indicated by way of example. As indicated in FIGS. 5 and 6, a second or intermediate dwelling unit level 18 is disposed above dwelling unit level 12 and a third dwelling unit level 20 is disposed above dwelling unit level 18. A module 10 comprising the dwelling unit levels 12, 18 and 20 may be repeated by "stacking" three story modules one on top of the other. Still further, these modules may be placed side-by-side and a corridor of each intermediate or second level, and to be described herein, could be interconnected with corresponding corridors for each additional module.

Referring again to FIG. 1, dwelling unit level 12 is delimited by opposed sidewalls 22 and 24 and opposed end walls 26 and 28. Dwelling unit level 12 is, by way of example, divided into two dwelling units, generally designated by the numerals 30 and 32, respectively and sharing a common wall 34, 36. The dwelling units 30 and 32 are accessed by a semi-private elevator 38 having suitable doors which open into respective vestibules 40 and 42 for the respective dwelling units 30 and 32. Vestibules 40 and 42 also open via doors 40*a* and 42*a* onto a landing 44 which is intersected by stairway 46. Landing 44 is enclosed by a peripheral wall 50 having doorways for the respective doors 40*a* and 42*a*. Landing 44 is also accessible from dwelling units 30 and 32 by additional doorways which include doors 40*b* and 42*b*, FIG. 1.

Figure 2:
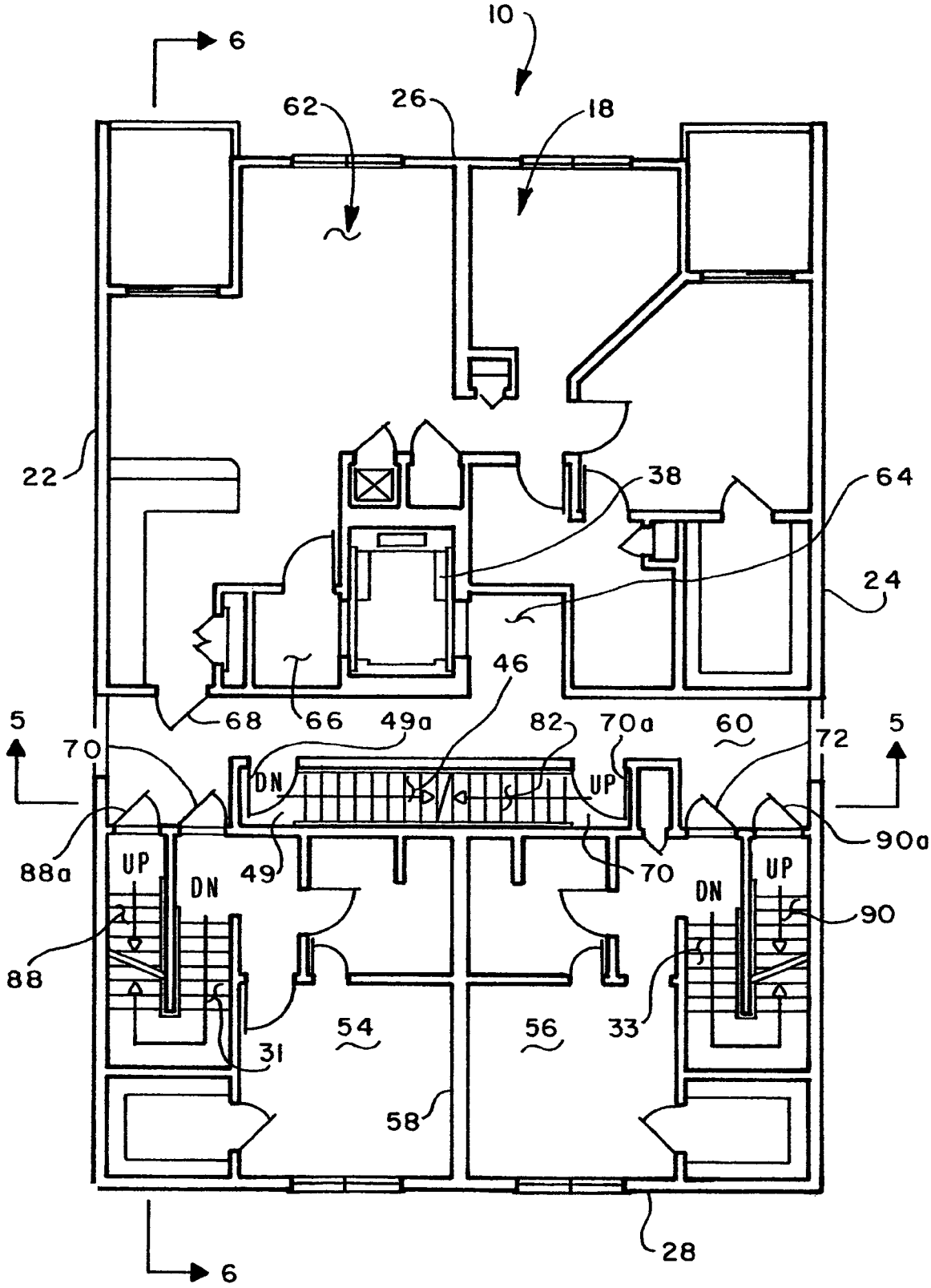
FIG. 2 is a plan view of a second or intermediate floor or level of the complex or module in accordance with the present invention.

Referring further to FIG. 1 and FIG. 2, dwelling units 30 and 32 include respective switchback style stairways 31 and 33 which lead from rooms 30*a* and 32*a* of the dwelling units 30 and 32 at dwelling unit level 12 to rooms 54 and 56 on dwelling unit level 18, see FIG. 2. Stairways 31 and 33 open into the rooms 54 and 56, respectively, and which are separated by a common wall 58.

As shown in FIGS. 2, 5 and 6, dwelling unit level 18 includes a somewhat central corridor 60 extending between walls 22 and 24. Corridor 60 opens at least through one of sidewalls 22 or 24 to an exit stairway, not shown, preferably leading to ground level. In the event that plural modules are placed side-by-side walls 22 and 24 are provided with openings such as to allow corridor 60 to continue to at least one exit stairway, not shown, to provide entry and exit with respect to the corridor 60 from the exterior of the building complex or module 10.

The remainder of dwelling unit level 18 includes a single dwelling unit 62 which may be accessed under normal circumstances by the occupants of the dwelling unit by way of elevator 38. At dwelling unit level 18, the elevator 38 opens to a vestibule 64 which opens directly to corridor 60. Elevator 38 also opens to a vestibule 66 which is an entrance to dwelling unit 62. However, dwelling unit 62 also includes an entry and exit path via a door 68 which opens into corridor 60. In like manner, rooms 54 and 56 of dwelling units 30 and 32 are provided with respective doors 70 and 72 which open into corridor 60. Accordingly, other than via elevator 38, persons occupying dwelling units 30, 32 and 62 may exit the respective dwelling units into corridor 60.

As shown in FIGS. 1, 2 and 5, persons occupying dwelling units 30 and 32 may exit the respective dwelling units by way of respective doors 40*a* or 40*b* and 42*a* or 42*b* onto landing 44, FIG. 1, and stairway 46 which leads to a landing 49, FIG. 2, and a door 49*a*, thereby providing access to corridor 60. Accordingly, occupants of dwelling units on level 12 and level 18 have access to corridor 60 in the manner described and illustrated. Still further, occupants of elevator 38 may also exit and/or enter the elevator directly via corridor 60 and vestibule 64.

Figure 4:
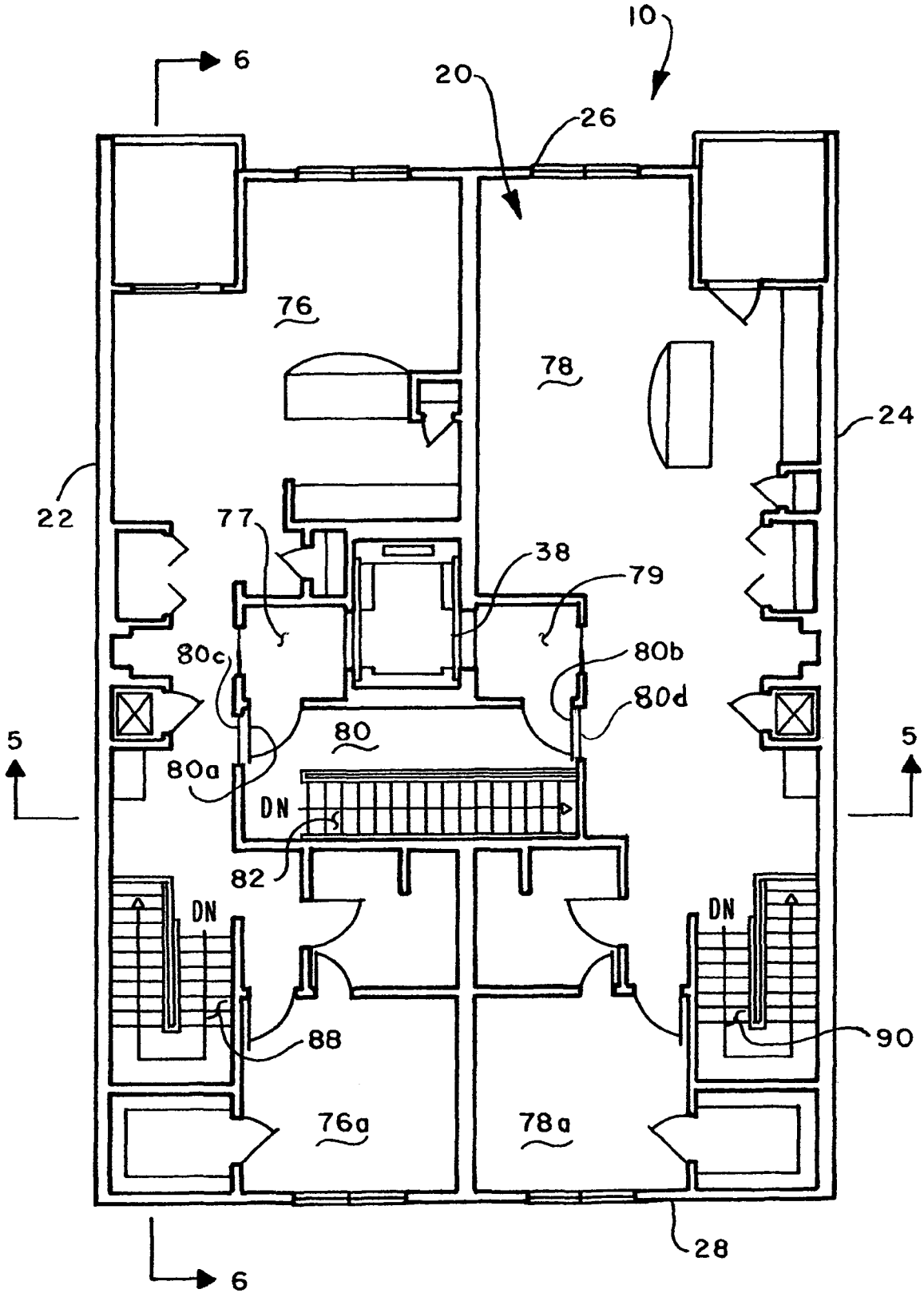
FIG. 4 is a plan view of a third or upper level of a three story module for the multiple dwelling unit complex of the invention.

Referring now to FIGS. 4, 5 and 6, a preferred arrangement of the third or upper floor 20 of the building complex or module 10 is illustrated as comprising dwelling units 76 and 78 which may be accessed via elevator 38 by way of respective vestibules 77 and 79. However, vestibules 77 and 79 also open to a stairway landing 80 by way of doors 80*a* and 80*b*, respectively. Alternate access to landing 80 is provided by doors 80*c* and 80*d* from respective dwelling units 76 and 78, FIG. 4. Stairway landing 80 provides access to a stairway 82 which leads to a landing 49*b*, FIG. 2 and FIG. 5, and access to corridor 60 is obtained from landing 49*a* via door 70*a*.

Referring further to FIGS. 2, 4 and 6, as shown in FIGS. 2 and 4, access to corridor 60, FIG. 2, may be obtained from dwelling units 76 and 78 by way of respective switchback stairways 88 and 90 which lead, respectively, to corridor 60 via doors 88*a* and 90*a*, respectively. FIG. 6 illustrates the configuration of stairway 88 and door 88*a* which opens directly to corridor 60. The configuration or arrangement of stairway 90 and door 90*a* is substantially a mirror image of stairway 88 and door 88*a*. Accordingly, access between corridor 60 and each of dwelling units 76 and 78 is provided via two pathways, namely the respective stairways 88 and 90 and the stairway 82. FIG. 6 illustrates the relationship of stairways 31 and 88. The relationship of stairways 33 and 90 is substantially a mirror image of what is shown in FIG. 6. Thus, in an emergency or for convenience, two pathways are provided between each of the dwelling units on the first and third levels and a corridor on the second or intermediate level. Of course, all dwelling units on the second or intermediate level also have direct access to corridor 60.

Figure 3:
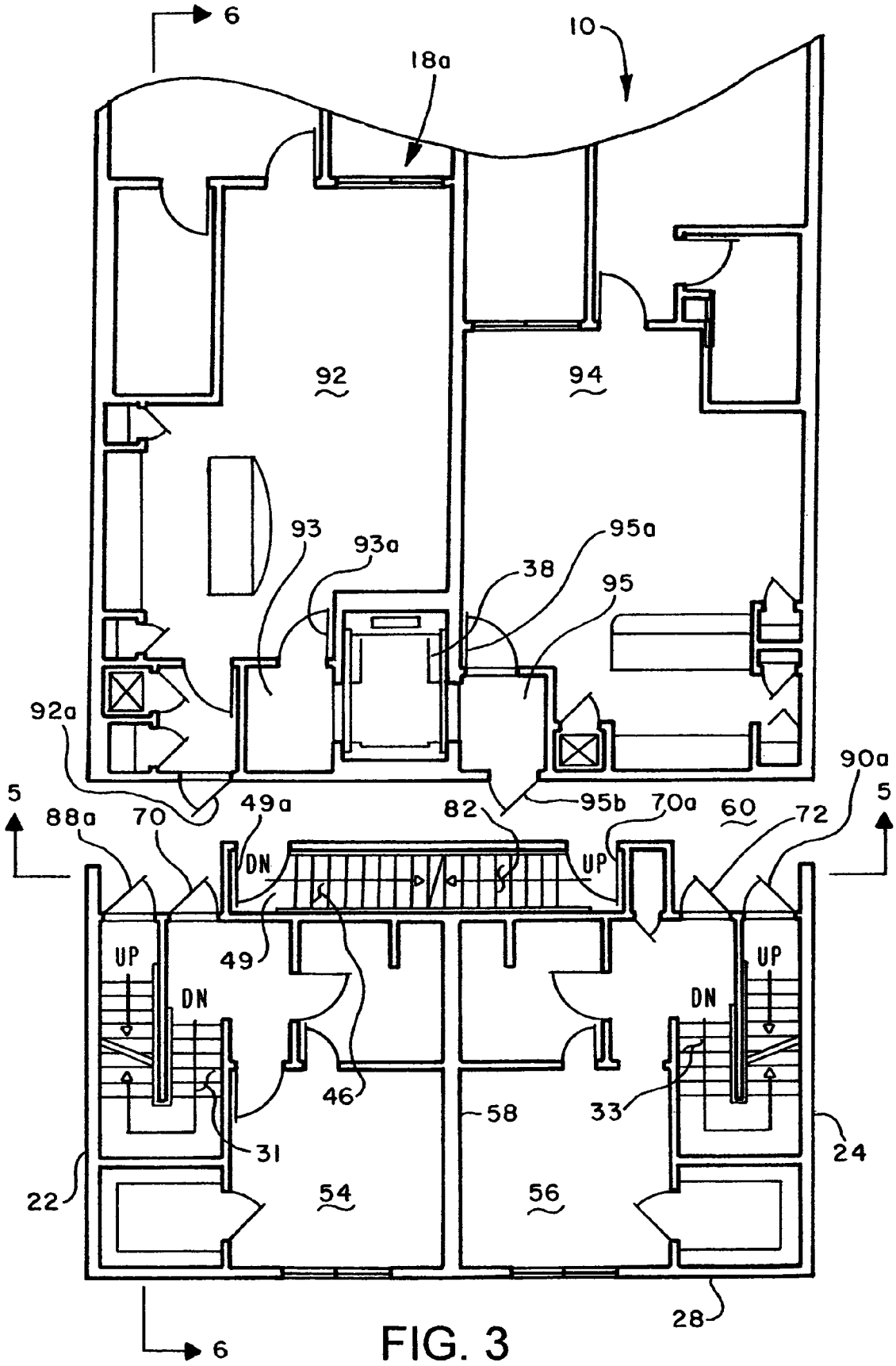
FIG. 3 is an alternate embodiment of an intermediate or second level floor plan in accordance with the present invention.

Referring briefly to FIG. 3, an alternate arrangement of the second or intermediate level for the complex or module 10 is illustrated and generally designated by the numeral 18*a*. In the embodiment of the intermediate level 18*a* illustrated in FIG. 3, separate dwelling units 92 and 94 are normally accessed by way of elevator 38 and respective vestibules 93 and 95 and via doors 93*a* and 95*a*. However, doors 92*a* and 95*b* open to corridor 60 from respective dwelling units 92 and 94, the latter including access to the corridor by way of the vestibule 95*a*. In other respects, the configuration of the intermediate level 18*a* is substantially like the intermediate level 18 illustrated in FIG. 2.

The particular arrangements of rooms for the respective dwelling units on each of the module levels 12, 18, 20 and 18*a* are exemplary. The rooms or living areas 54 and 56 of the dwelling units 30 and 32 situated on the second or intermediate levels 18 and 18*a* may, for example, be separate efficiency type apartments having access to corridor 60 by way of doors 70 and 72 and via other doors, not shown, opening from the upper landings for stairways 31 and 33 directly to such efficiency type dwelling units. As pointed out previously, an important aspect of the present invention is the provision of a multistory, multiple dwelling unit building complex or module wherein one service or alternate pathway corridor is provided on an intermediate level of a three story module, but is not required on each level since access to the intermediate level corridor can be obtained by at least one, and preferably two, direct pathways as illustrated and described.

Construction of a multistory building complex or module as described herein may be carried out using conventional techniques known to those skilled in the art and as described in the co-pending parent application. Although preferred embodiments of the invention have been described in detail herein, those skilled in the art will recognize that various substitutions and modifications may be made without departing from the scope and spirit of the appended claims.

What is claimed is:

1. A multistory multiple dwelling unit building complex comprising:

at least one multistory module comprising a first level including at least one first-level dwelling unit;

a second level of said module including at least one of a second-level dwelling unit, a part of said first-level dwelling unit, and a part of a third-level dwelling unit thereon and occupying at least a portion of said second level;

a third level of said module including at least one said third-level dwelling unit thereon;

said first and third levels having respective first-level and third-level landings extending only partially between one sidewall of said module and an opposite sidewall of said module;

a corridor on said second level, said corridor extending between said one sidewall of said module and said opposite sidewall of said module; and respective first pathways between said corridor and said first level, said second level and said third level, said respective first pathways providing access between said corridor and each of said first-, second-, and third-level dwelling units on respective first, second, and third levels.

2. The building complex set forth in claim 1 wherein:

access to said corridor is provided from said second-level dwelling unit on said second level and said part of at least one of said first- and third-level dwelling units on said second level via doorways opening to said corridor, respectively.

3. The building complex set forth in claim 1 wherein:

access to said corridor is provided between said corridor, said first level and said third level by respective stairways between said at least one first-level dwelling unit on said first level and said at least one third-level dwelling unit on said third level and said corridor, respectively.

4. The building complex set forth in claim 1 including:

an elevator operable to traverse between a ground level and each of said first, second and third levels of said module to provide access to respective first-, second-, and third-level dwelling units on each of said first, second, and third levels.

5. The building complex set forth in claim 4 including:

a pathway directly between said elevator and said corridor.

6. The building complex set forth in claim 5 wherein:

said pathway between said elevator and said corridor includes a vestibule opening to said elevator and to said corridor.

7. The building complex set forth in claim 6 wherein:

said vestibule includes a doorway opening to a dwelling unit on said second level.

8. The building complex set forth in claim 1 including:

respective second pathways between said at least one first-level dwelling unit on said first level and said corridor and between said at least one third-level dwelling unit on said third level and said corridor.

9. The building complex set forth in claim 8 wherein:

said second pathways comprise a first stairway between said corridor and said first-level landing and a second stairway between said corridor and said third-level landing, respectively.

10. The building complex set forth in claim 9 wherein:

said second pathways include doorways opening to said first- and third-level landings on said first and third levels from said first- and third-level dwelling units, respectively.

11. The building complex set forth in claim 9 wherein at least one third-level dwelling unit on said third level includes:

a vestibule between said at least one third-level dwelling unit on said third level and an elevator operable to provide access to said third level; and a doorway between said vestibule and said third-level landing; wherein said second pathway includes said second stairway between said third level and said corridor and an opening to said third-level landing.

12. The building complex set forth in claim 9 wherein said first level includes:

a vestibule disposed between said at least one first-level dwelling unit and an elevator, said vestibule opening to at least one first-level dwelling unit on said first level; and a doorway opening from said vestibule to said first-level landing for said first stairway between said corridor and said first-level landing.

13. A multistory multiple dwelling unit building complex comprising:

at least one multistory module comprising a first level including at least one first-level dwelling unit thereon;

a second level of said module including at least one second-level dwelling unit thereon and occupying at least a portion of said second level;

a third level of said module including at least one third-level dwelling unit thereon;

said second level includes a part of at least one of said first- and third-level dwelling units;

said first and third levels having respective first- and third-level landings extending only partially between one sidewall of said module and an opposite sidewall of said module;

a corridor on said second level only, said corridor extending between said one sidewall of said module and said opposite sidewall of said module;

respective first pathways between said corridor and said landing on said first level, said second level and said third level, said respective first pathways providing access between said corridor and each of said first-, second-, and third-level dwelling units on respective first, second, and third levels; and access to said corridor is provided from said second-level dwelling unit on said second level and said parts of at least one of said first- and third-level dwelling units on said second level via doorways opening to said corridor, respectively.

14. The building complex set forth in claim 13 including:

respective second pathways between said at least one first-level dwelling unit on said first level and said corridor and between said at least one third-level dwelling unit on said third level and said corridor.

15. The building complex set forth in claim 14 wherein:

said second pathways comprise a first stairway between said corridor and said first-level landing on said first level and a second stairway between said corridor and said third-level landing on said third level, respectively.

16. The building complex set forth in claim 15 wherein said at least one third-level dwelling unit on said third level includes:

a vestibule between said at least one third-level dwelling unit and an elevator operable to provide access to said third level; and a doorway between said vestibule and said third-level landing.

17. The building complex set forth in claim 15 wherein said first level includes:

a vestibule disposed between said at least one first-level dwelling unit and an elevator, said vestibule opening to said at least one first-level dwelling unit on said first level; and a doorway opening from said vestibule to said first-level landing.

18. The building complex set forth in claim 15 wherein:

said second pathways include doorways between respective ones of said first- and third-level dwelling units and said first- and third-level landings, respectively.

19. A multistory multiple dwelling unit building complex comprising:

at least one multistory module comprising a first level including at least one first-level dwelling unit thereon;

a second level of said module including at least one second-level dwelling unit thereon and occupying at least a portion of said second level; said second level including a portion of at least one of said first- and third level dwelling units a third level of said module including at least one third-level dwelling unit thereon;

said first and third levels having respective first-level and third-level landings extending only partially between one sidewall of said module and an opposite sidewall of said module;

an exit corridor on said second level only, said corridor extending between said one sidewall of said module and said opposite sidewall of said module;

respective first pathways between said corridor and said first level, said second level and said third level, said respective first pathways providing access between said corridor and each of said first-, second-, and third-level dwelling units on respective first, second, and third levels; and respective second pathways between said at least one first-level dwelling unit on said first level and said corridor and between said at least one third-level dwelling unit on said third level and said corridor.

20. The building complex set forth in claim 19 wherein said second pathways comprise:

a stairway between said corridor and said first-level landing on said first level; and a stairway between said corridor and said third-level landing on said third level.

21. The building complex set forth in claim 20 wherein said at least one third-level dwelling unit on said third level includes:

a vestibule between said at least one third-level dwelling unit and an elevator operable to provide access to said third level; and a doorway between said vestibule and said third-level landing.

22. The building complex set forth in claim 20 wherein said first level includes:

a vestibule disposed between said at least one first-level dwelling unit and an elevator, said vestibule opening to said at least one first-level dwelling unit on said first level; and a doorway opening from said vestibule to said first-level landing.

* * * * *